US005409082A

United States Patent [19]

Matthews

[11] Patent Number: 5,409,082

[45] Date of Patent: Apr. 25, 1995

[54] PLANK SUPPORT JACKET

[76] Inventor: LeRoy Matthews, 5 Copperfield Dr., Hawthorn Woods, Ill. 60047

[21] Appl. No.: 170,416

[22] Filed: Dec. 20, 1993

Related U.S. Application Data

[63] Continuation of Ser. No. 972,389, Nov. 5, 1992, abandoned.

[51] Int. Cl.[6] ..... E04G 1/15

[52] U.S. Cl. ..... 182/222; 182/119

[58] Field of Search ..... 182/222, 119, 223; 52/822; 248/300

[56] References Cited

U.S. PATENT DOCUMENTS 1,810,579 6/1931 Schmitz ..... 52/822

5,141,078 8/1992 Wood ..... 182/222

FOREIGN PATENT DOCUMENTS 945412 6/1956 Germany ..... 182/222

*Primary Examiner*—Alvin C. Chin-Shue

*Attorney, Agent, or Firm*—James P. Hanrath

[57] ABSTRACT

The PLANK SUPPORT JACKET comprises an upper horizontal ledge and a lower horizontal ledge joined to a vertical wall member, each ledge extending from the vertical wall member in a direction opposite each other and means for connecting the vertical wall member to a longitudinal side surface of a plank of wood to be supported thereby such as to dispose the lower horizontal ledge adjacent the underside surface of the plank and the upper horizontal ledge in substantially axial alignment to the upper surface of the plank.

1 Claim, 3 Drawing Sheets

PLANK SUPPORT JACKET

This is a continuation of application Ser. No. 07/972,389, filed on Sep. 5, 1992 abandoned.

BACKGROUND OF THE INVENTION

1. Field of the Invention.

The present invention relates generally to stagings, planks, scaffolds, or boards, and more particularly to a PLANK SUPPORT JACKET to avoid or minimize bowing, bouncing, or movement of the staging, plank, scaffold, or board it is supporting.

2. Description of the related art including information disclosed under 37 CFR §1.97–1.99

Heretofore, people have used scaffold boards or planks in conjunction with scaffold supporting devices. For example, a plank may be positioned with each end thereof resting on a selected step of a pair of placed supports to dispose the plank in horizontal supported position and thus allow work to be performed therefrom. In such a position, the plank may be subject to bowing or other bouncing or undesirable movement depending upon the length of the plank, the quality of the support structures, the weight placed upon the plank, and other factors.

In U.S. Pat. No. 2,808,296 to Stinson, there is disclosed a scaffold plank designed not to be liable to sag between supports upon which its ends rest when in use. This scaffold plank is formed of upper and lower sheets of plywood which are held in proper spaced relation to each other by longitudinally extending light metal rails, channel shaped and tapering to effectively secure the boards bowed longitudinally so that they are spaced from each other at a point midway between the length of the plank and converge towards the ends of the plank. The longitudinally extending rails comprise lightweight channels having webs tapering from a maximum width midway between the ends of the plywood sheets to a minimum width at the ends of the plywood sheets, the channels having flanges through which rivets may be passed to secure the plywood sheets to the rails.

In U.S. Pat. Des. No. 247,722 there is disclosed an ornamental design for a bracket support for a workman's plank providing a C-shaped bracket supported by legs to secure a workman's plank.

In U.S. Pat. No. 2,674,017 to Barnett there is disclosed a sheathing splice designed to secure the ends of two planks together by use of a sheathing splice cooperative with slots milled in the boards supported thereby.

In U.S. Pat. No. 1,687,706 to Bauer there is disclosed a reinforced scaffold plank wherein the plank at its underside is provided with a tension member, preferably in the form of a steel cable, anchored at the ends of the plank and adapted to be tensioned by means of a pivoted torsion bridge or cam element intermediate the ends of the plank.

The PLANK SUPPORT JACKET of the present invention comprises an upper horizontal ledge and a lower horizontal ledge joined to a vertical wall member, each ledge extending from the vertical wall member in a direction opposite the other, and means for connecting the vertical wall member to the longitudinal side surface of a plank to be supported thereby such that the lower horizontal ledge is disposed adjacent to the underside surface of the plank and the upper horizontal ledge is disposed in substantially axial alignment to the upper surface of the supported plank.

Such structure advantageously avoids or minimizes longitudinal bowing or bouncing or other undesirable movement of the plank independent of scaffold support structures or special ledges or brackets thereof, and requires no special milling of the plank of wood to be supported. Further, the present invention beneficially provides reinforcing means for a scaffold board or plank, so that the board or plank may be made of considerably less thickness relative to its length and yet have greater supporting strength. Still further, the upper horizontal ledge of the PLANK SUPPORT JACKET serves as a visual definition of the plank longitudinal boundary and also as a warning track to the supported plank. Preferably, the upper ledge is serrated to guard against slippage. Also, the the upper horizontal ledge of the PLANK SUPPORT JACKET may extend outwardly from the upper surface of the supported plank a sufficient distance to shield the means for connecting the vertical wall member to the longitudinal side surface of the supported plank thereby promoting safety of workers upon the plank by avoiding tripping on or entanglement of clothing or work materials with the connecting means.

SUMMARY OF THE INVENTION

According to the present invention there is provided a plank support jacket comprising an upper horizontal ledge and a lower horizontal ledge joined to a vertical wall member, each ledge extending from the vertical wall member in a direction opposite each other, and means for connecting the vertical wall member to a longitudinal side surface of a plank to be supported thereby to dispose the lower horizontal ledge adjacent to the underside surface of the plank and the upper horizontal ledge in substantially axial alignment from the upper surface of the plank.

Additional features and advantages of the present invention will become apparent to those skilled in the art from the following description and the accompanying figures illustrating the preferred embodiment of the invention, the same being the present best mode for carrying out the invention.

DESCRIPTION OF THE PREFERRED EMBODIMENTS

Figure 1:
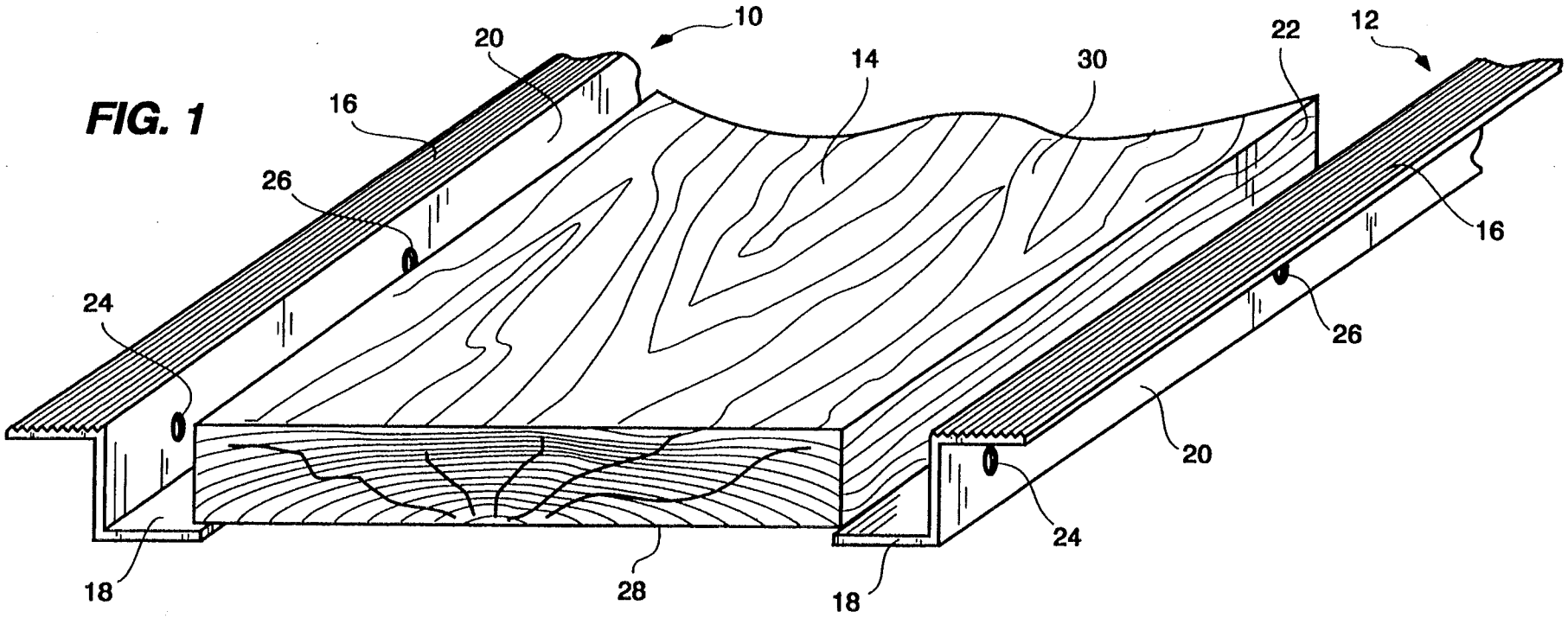
FIG. 1 is a partial top perspective view of a pair of plank support jackets constructed in accordance with the present invention exploded from a plank of wood therebetween.

Referring now to FIG. 1, there is shown therein a partial top perspective view of a pair of plank support jackets 10 and 12 exploded from a plank of wood 14 therebetween. Plank support jackets 10 and 12 are of identical construction. Each support jacket comprises an upper horizontal ledge 16 and a lower horizontal edge 18 joined to a vertical wall member 20, each ledge extending from the vertical wall member 20 in a direction opposite each other. In this regard, lower horizontal ledge 18 extends inwardly toward wood plank 14 from vertical wall member 20 while upper horizontal ledge 12 extends outwardly of wood plank 14 from vertical wall member 20. Each support jacket includes means for connecting vertical wall member 20 to a longitudinal side surface 22 of wood plank 14. The means for connecting the vertical wall member 20 to the longitudinal side surface 22 of plank 14 may include the vertical wall member 20 having a plurality of holes 24, 26 spaced longitudinally along vertical wall member 20 which serves as ports for nails, screws, lugs, bolts, or other connecting means to be inserted therethrough and into the longitudinal side surface 22 of plank 14 to affix (either permanently or removably) the wall member 20 to plank 14 such as to dispose lower horizontal ledge 18 adjacent and in a supporting and reinforcing position to the underside surface 28 of wood plank 14 and to dispose the upper horizontal ledge 16 in substantially axial alignment to upper surface 30 of plank 14.

Figure 2:
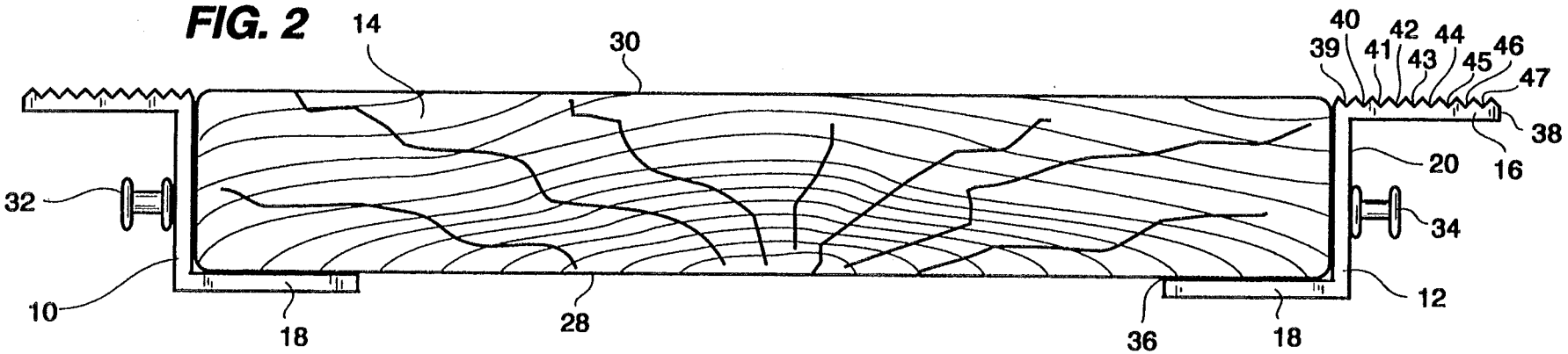
FIG. 2 is a end view of a pair of plank support jackets of the present invention attached to a plank.

FIG. 2 is an end view of plank support jackets 10 and 12 affixed to plank 14 by means of screws 32, 34 inserted through hole 24 of FIG. 1 and into the longitudinal side surface of plank 14 to securely, yet removably, affix the plank support jacket to the plank it is supporting such that upper face 36 of lower horizontal ledge 18 is disposed in a supporting reinforcing position adjacent the underside surface 28 of wood plank 14 while the upper face 38 of upper horizontal ledge 16 extends outwardly of upper surface 30 of plank 14 in substantially axial alignment thereto.

Figure 3:
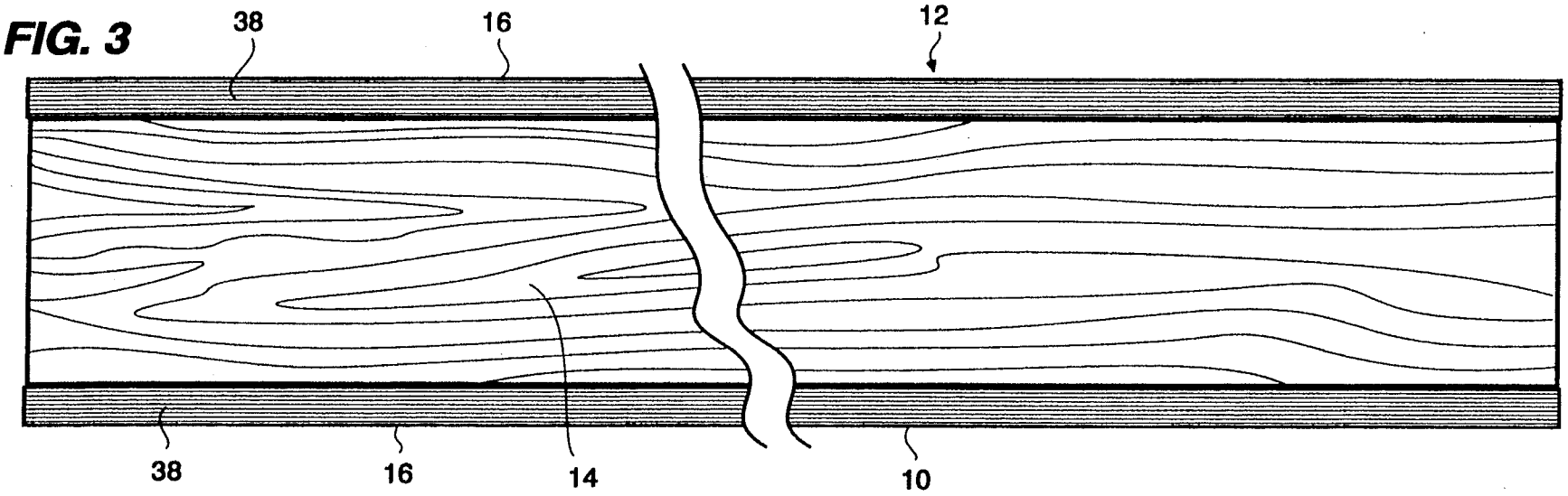
FIG. 3 is a top view of the plank support jackets and plank supported thereby illustrated at FIG. 2.

FIG. 2 also illustrates that the upper face 38 of upper horizontal ledge 16 may be provided with a plurality of grooves 38, 40, 41, 42, 43, 44, 45, 46, and 47 that forms a serrated top surface to upper face 38 to guard against slippage and to provide upper face 38 as a readily visible demarcation of the longitudinal boundary of plank 14 and as a warning track to users working upon a plank supported by the present invention. In this regard, FIG. 3 is a top view of the plank support jackets and plank supported thereby illustrated at FIG. 2 and shows upper face 38 of upper horizontal ledge 16 of both plank support jackets 10 and 12 serving as a readily accessible visual definition of the boundaries of plank 14.

As shown in FIG. 2, the height of vertical wall 20 corresponds to the thickness of wood plank 14 such that horizontal ledge 16 extends outwardly of upper surface 30 of wood plank 14 in substantial axial alignment thereto. Thus, the vertical wall member 20 may be dimensioned in various heights to accommodate and correspond to differing thicknesses of planks.

Figure 4:
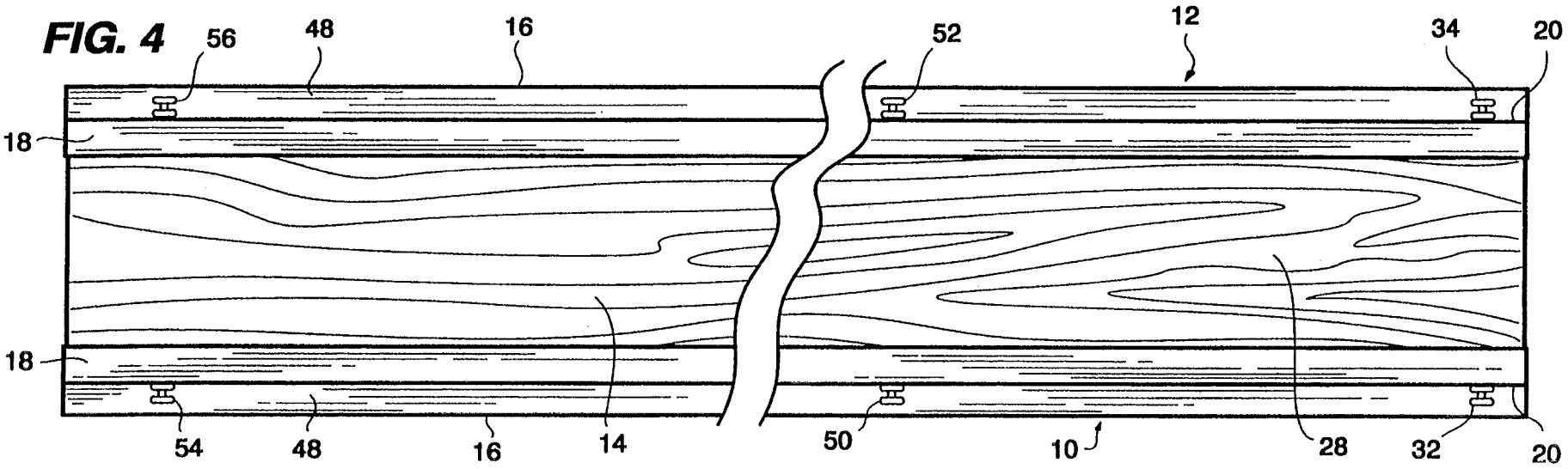
FIG. 4 is a bottom view of the plank support jackets and plank supported thereby illustrated at FIG. 2.

FIG. 4 shows a bottom view of plank support jackets 10 and 12 affixed to plank 14. Lower face 48 of upper horizontal ledge 16 extends outwardly from plank 14 a distance beyond connecting means screws 32, 34, 50, 52, 54, and 56 longitudinally spaced along vertical wall member 20 to thereby shield the means for connecting vertical wall member 20 to the longitudinal side surface 22 of plank 14. FIG. 4 also shows lower horizontal ledge 18 extending inwardly toward plank 14 from wall member 20 in abutment to underside surface 28 of plank 14.

Figure 5:
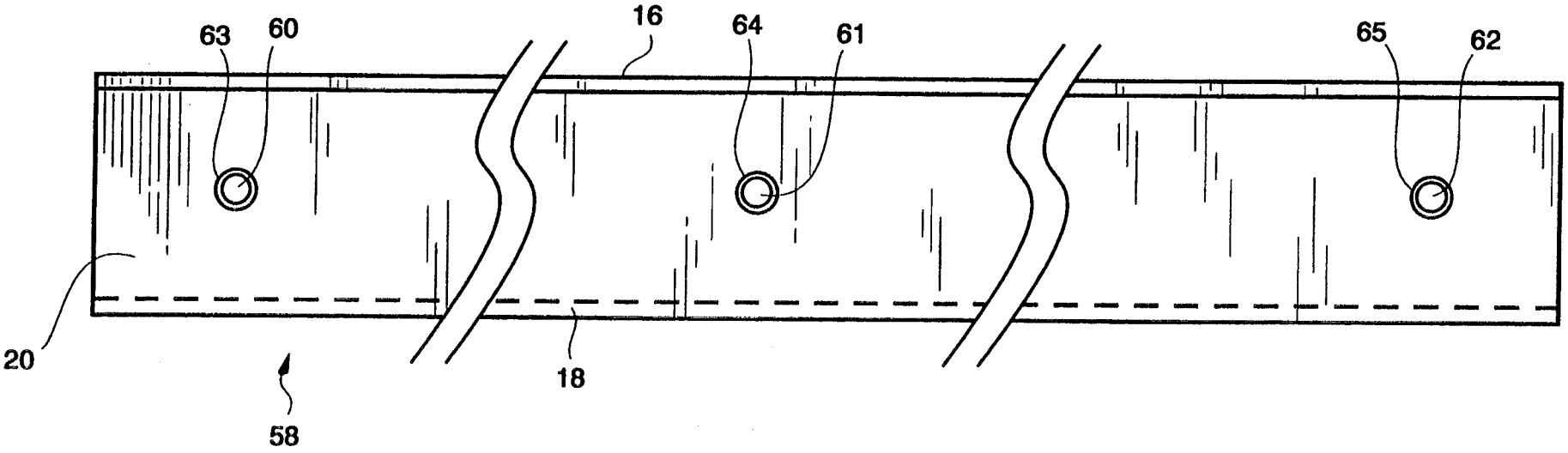
FIG. 5 is a side view of a plank support jacket and shows a plurality of holes in the vertical wall member fitted with a grommet.

FIG. 5 is a side view of plank support jacket 58 wherein vertical wall member 20 has a plurality of longitudinally spaced holes 60, 61, and 62 which are each fitted with grommets 63, 64, and 65 respectively. The plurality of holes 60, 61, and 62 are dimensioned to receive nails, screws, lugs, pins, bolts or similar means to be inserted therethrough and into the longitudinal side surface of a plank to affix the vertical wall member 20 to a plank to be supported thereby. The plurality of holes 60, 61, and 62 are also longitudinally axially aligned to one other along vertical wall member 20 at a selected interval, such as, for example, one hole at each twelfth inch of the length of the plank support jacket 58.

The dimensions of the plank support jacket can correspond to the type of wood plank it is to support. For example, for a 1.5 inch thick and 9.5 inch wide standard plank having a selected length, the plank support jacket would be dimensioned to have a 1.5 inch high vertical wall, a dimension for both the lower and upper horizontal ledges of 1.5 inch outwardly extending from the vertical wall member, a length corresponding to the selected length of the board, and a hole to the vertical wall member every 12 inches along such length. Although lower horizontal ledge may be greater than 1.5 inch in extension from the vertical wall member, a 1.5 inch dimension provides a substantial supporting reinforcement to the plank. Also, a dimension of 1.5 inches for the extension from the vertical wall member for the upper horizontal ledge of the plank support jacket should be sufficient to shield the means for connecting the vertical wall member to a longitudinal side surface of the plank it is supporting.

It is believed that the PLANK SUPPORT JACKET of the present invention in its described embodiments and with its attendant advantages will be fully understood from the foregoing description, and that changes may be made in form, construction and arrangement without departing from the spirit or scope of the invention or sacrificing any of the attendant advantages. The preferred embodiment illustrated is not intended to be exhausted or to limit the invention to the precise form disclosed. Accordingly, the scope of the invention is only to be limited as necessitated by the accompanying claims.

I claim:

1. A method for supporting a plank having an underside surface, an upper surface, and a longitudinal side surface comprising the steps of:

orientating a plank support jacket having an upper horizontal ledge and a lower horizontal ledge joined at opposite ends of a vertical wall member, each ledge extending from said vertical wall member in a direction opposite each other and said vertical wall member being both vertically dimensioned and horizontally dimensioned to correspond to the vertical and horizontal dimensions of said longitudinal side surface of said plank, to said longitudinal side surface of said plank so as to dispose said vertical wall member adjacent to said longitudinal side surface, to dispose said lower horizontal ledge in supporting contact with the underside surface of said plank, and to dispose said upper horizontal ledge to extend laterally outward from said longitudinal side surface of said plank in substantially axial alignment with the upper surface of said plank without contacting said plank, and connecting said plank support jacket to said plank when so orientated.

* * * * *